US012800220B2

(12) United States Patent
Wan et al.

(10) Patent No.: US 12,800,220 B2
(45) Date of Patent: Nov. 17, 2026

(54) FRESH PRODUCT COLD CHAIN DISTRIBUTION DEVICE AND DISTRIBUTION METHOD

(71) Applicant: Sichuan Academy of Agricultural Machinery Sciences, Chengdu (CN)

(72) Inventors: Yong Wan, Chengdu (CN); Huixia Jiang, Chengdu (CN); Ling Tang, Chengdu (CN); Wenjuan Xu, Chengdu (CN); Yiji Zhao, Chengdu (CN)

(73) Assignee: Sichuan Academy of Agricultural Machinery Sciences, Chengdu (CN)

( * ) Notice: Subject to any disclaimer, the term of this patent is extended or adjusted under 35 U.S.C. 154(b) by 481 days.

(21) Appl. No.: 18/395,767

(22) Filed: Dec. 26, 2023

(65) Prior Publication Data

US 2024/0210104 A1 Jun. 27, 2024

(30) Foreign Application Priority Data

Dec. 27, 2022 (CN) ..... 202211684525.2

(51) Int. Cl.
*F25D 31/00* (2006.01)
*F25D 17/06* (2006.01)
*F25D 29/00* (2006.01)

(52) U.S. Cl.
CPC ..... *F25D 31/006* (2013.01); *F25D 17/06* (2013.01); *F25D 29/005* (2013.01); (Continued)

(58) Field of Classification Search
CPC .. F25D 13/02; F25D 25/025; F25D 2400/361; F25D 2400/14; F25D 2331/804; F25D 29/005; F25D 17/06; F25D 31/006
See application file for complete search history.

(56) References Cited

U.S. PATENT DOCUMENTS

2026/0139896 A1* 5/2026 Belligundu ..... F25D 25/025

FOREIGN PATENT DOCUMENTS

CN 203970022 U 12/2014
CN 107209973 A 9/2017
(Continued)

OTHER PUBLICATIONS

CN-215015129-U translation.*

*Primary Examiner* — Elizabeth J Martin
(74) *Attorney, Agent, or Firm* — Bayramoglu Law Offices LLC

(57) ABSTRACT

A fresh product cold chain distribution device and a distribution method are provided. The fresh product cold chain distribution device comprises a self-service pickup cabinet and at least one refrigeration logistics box; the self-service fresh product pickup cabinet comprises a cabinet body, an air channel cover panel, a scanner, a touch display screen, a power supply plug, and a control panel; the self-service fresh product pickup cabinet is internally provided with an air circulation system consisting of an exhaust channel, exhaust holes of the self-service pickup cabinet unit cell, exhaust holes of the exhaust channel, an inlet channel, inlet holes of the inlet channel, and inlet holes of the self-service pickup cabinet unit cell; the cabinet body comprises a plurality of unit cells; the refrigeration logistics box comprises a box body, a quick-connection plug board, a refrigeration device, a temperature selection switch, and an identification.

16 Claims, 5 Drawing Sheets

(52) U.S. Cl.
CPC .... *F25D 2331/804* (2013.01); *F25D 2400/14* (2013.01); *F25D 2400/361* (2013.01)

(56) References Cited

FOREIGN PATENT DOCUMENTS

| | | | | |
|---|---|---|---|---|
| CN | 207141887 | | | 3/2018 |
| CN | 110979910 | A | | 4/2020 |
| CN | 211017842 | | | 7/2020 |
| CN | 215015129 | U | * | 12/2021 |
| JP | 2003010034 | | | 1/2003 |

* cited by examiner

FRESH PRODUCT COLD CHAIN DISTRIBUTION DEVICE AND DISTRIBUTION METHOD

CROSS-REFERENCE TO THE RELATED APPLICATIONS

This application is based upon and claims priority to Chinese Patent Application No. 202211684525.2, filed on Dec. 27, 2022, the entire contents of which are incorporated herein by reference.

TECHNICAL FIELD

The present invention relates to the technical field of fresh product cold chain preservation, and in particular to a fresh product cold chain distribution device and a distribution method.

BACKGROUND

In the modern logistics industry, fresh food transportation accounts for a large proportion. Fresh food, prone to quick spoilage, requires a whole process of cold chain transportation and distribution. With the rapid construction of China's cold chain logistics system, the whole process of cold chain logistics from the production end to the urban distribution center has been essentially solved. However, there are still many problems to be solved in the distribution mode and equipment from the urban distribution center to the consumer. The existing fresh product cold chain distribution method involves coordinating delivery times between the courier and the consumer, or the courier placing the fresh product in regular logistics pick-up lockers or community stores for the consumer to pick up. Cold chain distribution relies on insulated bags and foam insulated boxes, and fresh products are subject to passive insulation and warming processes, which require high delivery efficiency. This delivery method, while consuming a large amount of manpower, makes it difficult to guarantee the quality of fresh products. The main problems with the existing fresh product cold chain distribution are as follows: 1. the lack of a self-service device with multi-temperature zones, low energy consumption, and low cost along with a solution for fresh produce cold chain distribution. If a shared community refrigerator is used, firstly, the requirement of simultaneously preserving and freezing products in multi-temperature zones cannot be realized; secondly, the operation must be prolonged to keep a low temperature, and the energy consumption is bound to be high; thirdly, the equipment is expensive and the investment cost is high, and low utilization rate will lead to higher operation cost; fourthly, the foam insulated logistics box placed in the refrigerator must be unpacked to ensure low temperature of fresh products, which is easy to cause logistics confusion and fresh products contamination. 2. The logistics boxes used for cold chain delivery of fresh products lack refrigeration capacity and can only carry out passive insulation, and the temperature is increased in the distribution and storage processes, so that the distribution time is short, and the quality of the fresh products cannot be guaranteed. 3. The insulated logistics box for fresh product cold chain delivery is made of plastic foam, which is disposable and easily broken, and extensive use for a long time will cause serious environmental pollution.

SUMMARY

Aiming at the shortcomings in the prior art, the present invention aims to provide a fresh product cold chain distribution device and distribution method to achieve self-service, low energy consumption, and multi-temperature storage in the cold chain distribution, meet the requirements of long-term and constant-temperature refrigeration for fresh products, promote the recycling of the insulated logistics box, improve the distribution efficiency of fresh products, ensure the best refrigeration effect of fresh products in the whole process, improve product quality, and reduce environmental pollution.

In order to achieve the purposes described above, the technical solution adopted by the present invention is as follows: a fresh product cold chain distribution device, comprising at least one refrigeration logistics box and a self-service fresh product pickup cabinet. The refrigeration logistics box comprises a box body, a box cover, a side cover, a quick-connection plug board, a refrigeration device, a temperature selection switch, and an identification; the box body comprises a positioning slot and air guide grooves; the refrigeration logistics box is matched and fixedly placed in the self-service pickup cabinet unit cell through the positioning slot and the limiting lock in the self-service pickup cabinet unit cell. The self-service fresh product pickup cabinet comprises a cabinet body, a side panel, a back panel, a top panel, a door panel, an air channel cover panel, an exhaust channel, an inlet channel, a scanner, a touch display screen, and a control panel; the cabinet body comprises a plurality of unit cells, each unit cell is provided with a door panel, an electric door lock, a contact power supply plug, a limiting lock, inlet holes of the self-service pickup cabinet unit cell, exhaust holes of the self-service pickup cabinet unit cell, and an inlet channel and an exhaust channel are provided between each set of unit cells.

The above device uses the refrigeration logistics box equipped with a refrigeration device to store fresh products requiring low-temperature preservation during the distribution process. The temperature of the refrigeration logistics box is adjusted through the temperature selection switch, and the logistics box is continuously powered during the distribution process by connecting the power supply interface on the quick-connection plug board of the refrigeration logistics box to the power supply end of the delivery vehicle. In the delivery terminal, different specifications of refrigeration logistics boxes with fresh products are stored in multiple unit cells of the self-service fresh product pickup cabinet, and the refrigeration logistics box is continuously powered through the contact power supply plug in the unit cell and the elastic contact points on the quick-connection plug board of the refrigeration logistics box. The refrigeration logistics box is positioned and fixed by the limiting lock, and the heat released by the refrigeration logistics box is discharged through the air channel between unit cells to cool down the unit cell. The refrigeration logistics box can be stored in the self-service fresh product pickup cabinet for a long time, and consumers can freely pick up the products, which greatly improves the distribution efficiency while ensuring the quality of fresh products.

Furthermore, the quick-connection plug board of the refrigeration logistics box is arranged on the side panel on the same side as the positioning slot at the box bottom. The quick-connection plug board includes a panel, a box body, elastic contact points, a storage battery standard plug, and a power transmission interface. The elastic contact points are connected to and cooperated with the contact plug in the unit cell to supply power to the refrigeration logistics box, and the storage battery standard plug is connected to the storage battery of the logistics distribution vehicle to ensure the power supply to the refrigeration logistics box.

Furthermore, the temperature selection switch of the refrigeration logistics box comprises a temperature sensor and a refrigeration device controller. Two preservation modes of refrigeration and freezing can be set for the refrigeration logistics box by the temperature selection switch.

Furthermore, the bottom of the box body is provided with a positioning slot which is on the same side as the quick-connection plug board of the refrigeration logistics box. The positioning slot is provided with a positioning slot bayonet which is matched with the tongue of the limiting lock in the self-service pickup cabinet unit cell. When the refrigeration logistics box is placed into the self-service pickup cabinet unit cell, the positioning slot is matched with the limiting lock for position guidance. After the tongue of the limiting lock is stuck into the positioning slot bayonet, the clearance between the refrigeration logistics box and the unit cell is fixed, ensuring proper contact of the power supply contact points.

Furthermore, a refrigeration device is provided in the refrigeration logistics box, and heat generated by the refrigeration device is dissipated through the surface of the box body.

Furthermore, air guide grooves are also formed on the bottom of the box body to ensure uniform heat dissipation from the bottom of the refrigeration logistics box during delivery. When the refrigeration logistics box is stored in the self-service pickup cabinet unit cell, air channels formed between the inlet holes and the exhaust holes of the unit cells allow for uniform temperature reduction within the refrigeration logistics box.

Furthermore, the box body is made of hard insulating material, and the surface of the box body has a heat dissipation function.

Furthermore, the surface of the box body is provided with a unique identification mark.

Furthermore, the contact power supply plug in the self-service pickup cabinet unit cell comprises a plug panel, a plug box body, elastic contact points, and a power connection port. The contact power supply plug provides an uninterrupted power supply to the refrigeration logistics box to ensure a constant temperature in the refrigeration logistics box during storage.

Furthermore, the limiting lock is matched with the positioning slot on the refrigeration logistics box, and the limiting lock comprises an electronic lock tongue that can lock into the positioning slot bayonet of the refrigeration logistics box, a control line connection port, and a mounting hole. The limiting lock is synchronized with the electric door lock and can guide and fix the refrigeration logistics box when the refrigeration logistics box is put in, ensuring accurate and close contact between the contact power supply plug and the elastic contact points of the quick-connection plug board of the refrigeration logistics box.

Furthermore, an exhaust channel is provided on the outer side of and an inlet channel is provided between every two columns of unit cells of the self-service fresh product pickup cabinet. Exhaust holes of the unit cell and exhaust holes of the exhaust channel are formed on the exhaust channel side, and inlet holes of the unit cell and inlet holes of the inlet channel are formed on the inlet channel side. The inlet holes of the inlet channel are equipped with an inlet fan of the inlet channel for forced air inlet, forming an air circulation system capable of discharging the heat generated by the refrigeration logistics box through the exhaust holes of the unit cell and the exhaust channel to avoid high temperature in the unit cell.

Furthermore, within the self-service pickup cabinet unit cell, inlet holes are formed at the lower part of the side partition near the inlet channel, and exhaust holes are formed at the upper part of the side partition near the exhaust channel. The cold air enters the unit cell from the inlet holes, flows out from the exhaust holes through the surface of the refrigeration logistics box and the guide grooves, and enters the exhaust channel.

Furthermore, the self-service fresh product pickup cabinet can be used as a general logistics self-service pickup cabinet.

Furthermore, the drawings in the present invention are provided only for better illustration of the features of the device provided by the present invention and do not represent the actual nature of the device disclosed herein.

Preferably, an exhaust fan can be installed at the exhaust holes of the exhaust channel to perform forced exhaust, which facilitates air flow and heat dissipation.

Preferably, the refrigeration device can adopt electronic semiconductor refrigeration to reduce the volume and the cost.

Preferably, the identification of the refrigeration logistics box can adopt a bar code, a two-dimensional code, and an RFID tag.

On the other hand, the present invention further provides a distribution method using the fresh product cold chain distribution device described above and comprising the following steps:

step 1, before loading the fresh products, toggling the temperature selection switch of the refrigeration logistics box to select a temperature suitable for preserving the distributed fresh products; during transportation from a logistics center to a centralized distribution point, the refrigeration logistics box with the products being placed on a shelf of a logistics transport vehicle, wherein the shelf is equipped with a contact power supply plug, and power is supplied to the refrigeration device of the refrigeration logistics box through the quick-connection plug board on the refrigeration logistics box and the contact power supply plug, ensuring a constant temperature in the refrigeration logistics box throughout the whole process;

step 2, in the storage process in the centralized distribution point, supplying power to the refrigeration equipment of the refrigeration logistics box by using the shelf equipped with the contact power supply plug;

step 3, on the way of delivery of the courier, supplying power to the refrigeration logistics box by using the shelf equipped with the contact power supply plug or by connecting the storage battery standard plug on the quick-connection plug board of the refrigeration logistics box to a storage battery of a battery car;

step 4, identifying the identification of the refrigeration logistics box with the scanner on the self-service fresh product pickup cabinet to open the electric door lock of the unit cell; when the courier puts the refrigeration logistics box into the unit cell, the limiting lock cooperating with the positioning slot to guide and fix the refrigeration logistics box; after the control panel detects the connection of the power supply contact points, the touch display screen of the self-service fresh product pickup cabinet prompting to close the door panel of the unit cell and sending a pickup verification code to the consumer; powering the refrigeration logistics box through the contact power supply plug inside the self-service pickup cabinet unit cell; the inlet channel and the exhaust channel constituting an air circulation system to discharge the heat released during refrigeration of the refrigeration logistics box;

step 5, after the consumer inputs the pickup verification code, the electric door lock and the limiting lock of the unit cell being automatically unlocked; the consumer taking away the fresh products directly from the refrigeration logistics box and returning back the refrigeration logistics box to the unit cell immediately; after the control system of the self-service fresh product pickup cabinet detects the connection of the power supply contact points in the unit cell, the touch display screen of the self-service fresh product pickup cabinet prompting to close the door panel of the unit cell; the consumer closing the door panel of the unit cell to complete the pickup; then the control system of the self-service fresh product pickup cabinet cutting off the power of the power supply system of the unit cell to prevent energy consumption from the vacant refrigeration logistics box; or to ensure better fresh quality, the consumer opting for a network credit guarantee and then taking away the refrigeration logistics box, and the self-service fresh product pickup cabinet reserving the corresponding unit cell after the consumer takes away the refrigeration logistics box; the consumer returning the refrigeration logistics box back by scanning again the identification of the refrigeration logistics box; and step 6, the courier putting in a new refrigeration logistics box in the next delivery and retrieving the vacant refrigeration logistics for reuse.

The beneficial effects of the present invention are as follows:

(1) The distribution device and the distribution method provided by the present invention solve the problem of cold chain delivery and self-service pickup of fresh products and achieve constant temperature throughout the whole process of cold chain distribution.

(2) The refrigeration logistics box provided by the present invention can regulate the refrigeration temperature by the temperature selection switch, so that the differentiated temperature demand for different fresh products in cold chain distribution is met.

(3) In the self-service fresh product pickup cabinet provided by the present invention, an air channel system is designed to cool the refrigeration logistics box, preventing increased energy consumption of the refrigeration equipment of the refrigeration logistics box stored in the unit cell under high temperature conditions. Compared with ordinary self-service pickup cabinets, the self-service fresh product pickup cabinet only adds a low-energy air inlet fan of the inlet channel, and power is only supplied when fresh products are stored in the refrigeration logistics box, which achieves the lowest overall energy consumption.

(4) Compared with ordinary self-service pickup cabinets, the self-service fresh product pickup cabinet provided by the present invention only adds an air channel, an air inlet fan, a positioning lock, and a contact power supply plug, thus the equipment cost is not much different from that of the ordinary self-service pickup cabinets, and power is only supplied when fresh products are stored in the refrigeration logistics box, thus the construction and operation cost is minimized.

(5) The power supply device and the method provided by the present invention achieve continuous refrigeration of the refrigeration logistics box, ensuring optimal preserving temperature for the products and maximized fresh quality throughout the entire process from distribution to the self-service fresh product pickup cabinet to consumers' homes.

(6) The distribution device and the distribution method provided by the present invention allow staggered delivery time between the courier and the consumer, get rid of the limitation of delivery time, avoid the problem of courier occupancy caused by face-to-face transactions, improve the distribution efficiency, and reduce the distribution cost.

(7) The refrigeration logistics box provided by the present invention can be recycled, so that the environmental pollution is reduced.

(8) The self-service fresh product pickup cabinet provided by the present invention can also be used as a general self-service pickup cabinet to maximize the utilization rate.

In the figures: 1. self-service fresh product pickup cabinet; 11. body of the self-service fresh product pickup cabinet; 110. unit cells; 111. exhaust grille of the self-service fresh product pickup cabinet; 12. side panel of the self-service fresh product pickup cabinet; 13. back panel of the self-service fresh product pickup cabinet; 14. top panel of the self-service fresh product pickup cabinet; 15. a door panel of the self-service fresh product pickup cabinet; 151. electric door lock; 16. air channel cover panel of the self-service fresh product pickup cabinet; 17. scanner; 18. touch display screen; 19. contact power supply plug; 191. plug panel; 192. plug box body; 193. elastic contact point; 194. power connection port; 100. limiting lock; 1001. electronic lock tongue; 1002. control line connection port; 1003. mounting hole; 101. exhaust channel; 1011. exhaust hole of a self-service pickup cabinet unit cell; 1012. exhaust hole of the exhaust channel; 102. inlet channel; 1021. inlet hole of the inlet channel; 1022. inlet hole of the self-service pickup cabinet unit cell; 1023. inlet fan of the inlet channel; 2. refrigeration logistics box; 21. box body; 211. air guide groove; 212. positioning slot; 213. positioning slot bayonet; 22. cover of the refrigeration logistics box; 23. side cover of the refrigeration logistics box; 231. quick-connection plug board; 2311. panel; 2312. box body; 2313. elastic contact point; 2314. storage battery standard plug; 232. temperature selection switch; 24. refrigeration device; 25. identification of the refrigeration logistics box.

DETAILED DESCRIPTION OF THE EMBODIMENTS

In order to further explain the technical solutions in the present invention, the present invention is explained in detail below by the specific embodiments.

Figure 1:
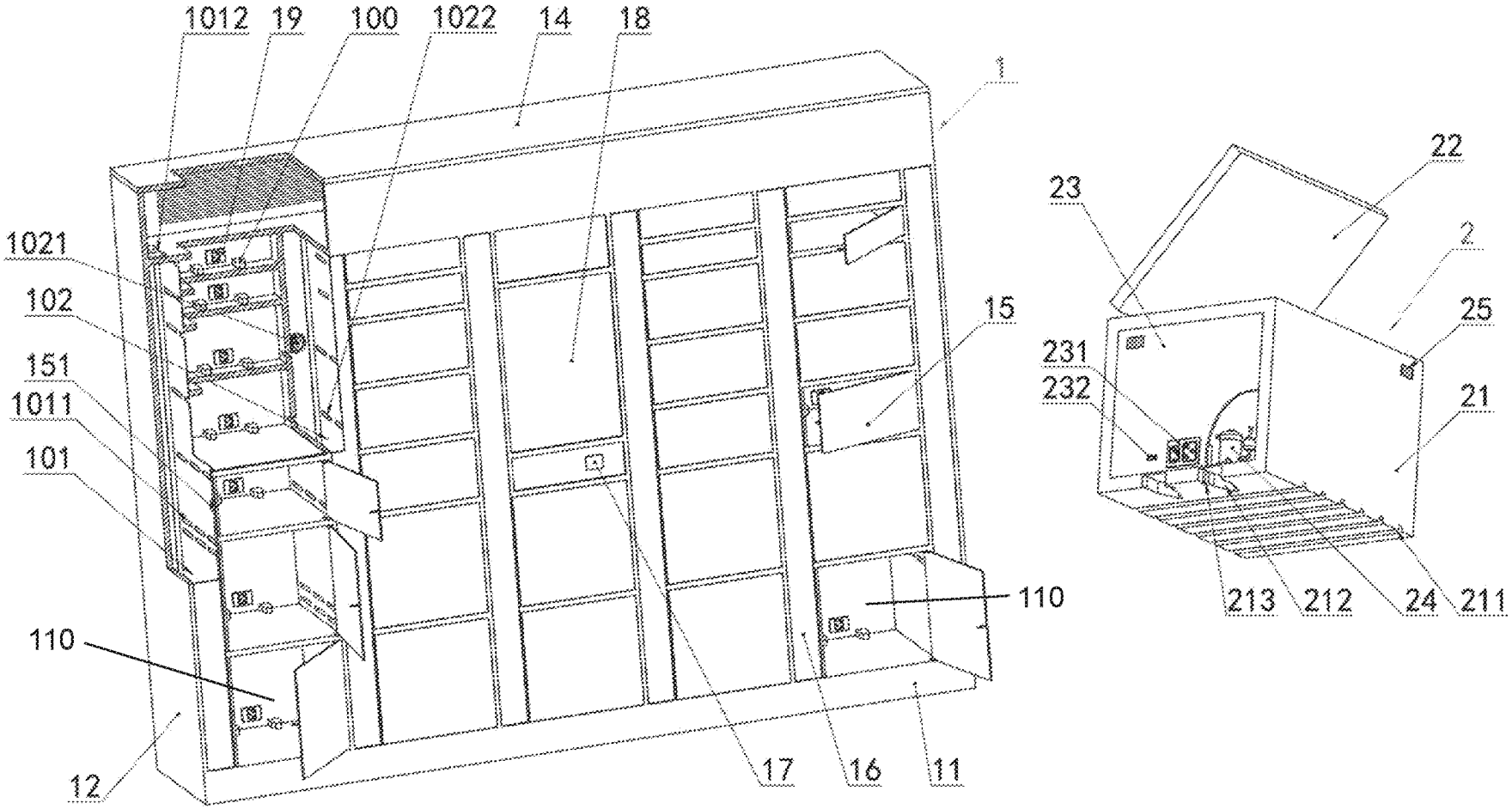
FIG. 1 is a schematic diagram of a fresh product cold chain distribution device according to the present invention.
Figure 2:
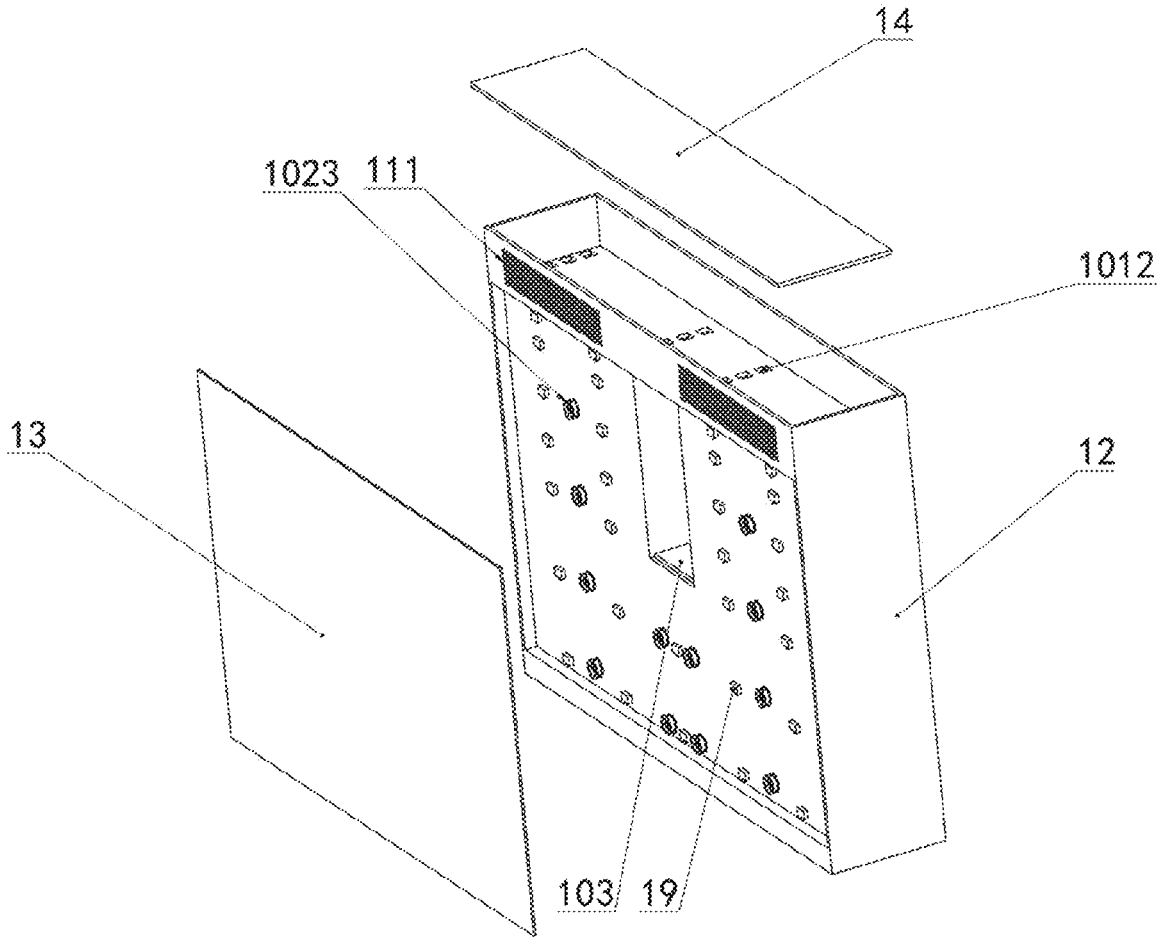
FIG. 2 is a schematic diagram of the back structure of a self-service fresh product pickup cabinet according to the present invention.

Referring to FIGS. 1 and 2, the fresh product cold chain distribution device of the present invention comprises at least one refrigeration logistics box 2 and a self-service fresh product pickup cabinet 1. The refrigeration logistics box 2 comprises a box body 21, a box cover 22, a side cover 23, a quick-connection plug board 231, a refrigeration device 24, a temperature selection switch 232, and an identification 25; the box body 21 comprises a positioning slot 212 and air guide grooves 211; the refrigeration logistics box 2 is matched and fixedly placed in the self-service pickup cabinet unit cell 110 through the positioning slot 212 and the limiting lock 100 in the self-service pickup cabinet unit cell 110. The self-service fresh product pickup cabinet 1 comprises a cabinet body 11, a side panel 12, a back panel 13, a top panel 14, a door panel 15, an air channel cover panel 16, an exhaust channel 101, an inlet channel 102, a scanner 17, a touch display screen, 18 and a control panel 103; the cabinet body 11 comprises a plurality of unit cells 110, each unit cell 110 is provided with a door panel 15, an electric door lock 151, a contact power supply plug 19, a limiting lock 100, inlet holes 1022 of the self-service pickup cabinet unit cell 110, and exhaust holes 1011 of the self-service pickup cabinet unit cell 110, and an inlet channel 102 and an exhaust channel 101 are provided between each set of unit cells 110.

In the present invention, the refrigeration logistics box 2 equipped with a refrigeration device 24 is used to store fresh products requiring low-temperature preservation during the distribution process. The temperature of the refrigeration logistics box 2 is adjusted through the temperature selection switch 232, and the refrigeration logistics box 2 is continuously powered during the distribution by connecting the power supply interface on the quick-connection plug board 231 of the refrigeration logistics box 2 to the power supply end of the delivery vehicle. In the delivery terminal, the courier scans the identification 25 of the refrigeration logistics box using the scanner 17 on the self-service fresh product pickup cabinet 1 and stores the refrigeration logistics box 2; in the unit cell 110, the refrigeration logistics box 2 is positioned and fixed by the limiting lock 100, and the refrigeration logistics box 2 is continuously powered through the contact power supply plug 19 and the elastic contact point on the quick-connection plug board 231 of the refrigeration logistics box 2; the heat released by the refrigeration logistics box 2 is discharged through the air channel between unit cells 110 to cool down the unit cell 110 and reduce energy consumption. The self-service fresh product pickup cabinet 1 can store the refrigeration logistics box 2 for a long time, allowing consumers to freely pick up the products. After the consumer takes the fresh products and returns the refrigeration logistics box 2, the courier can retrieve and reuse the refrigeration logistics box 2.

In the present invention, the refrigeration logistics box 2 equipped with a refrigeration device 24 is used to store fresh products requiring low-temperature preservation during the distribution process. In the delivery terminal, the refrigeration logistics box 2 filled with fresh products is stored in one of the plurality of unit cells 110 on the self-service fresh product pickup cabinet 1, and the refrigeration logistics box 2 is continuously powered through the contact power supply plug 19 and the elastic contact point on the quick-connection plug board 231. By doing so, the temperature during the whole delivery process remains constant, and consumers can pick up the products freely, which ensures the product quality and greatly improves the convenience.

Figure 3:
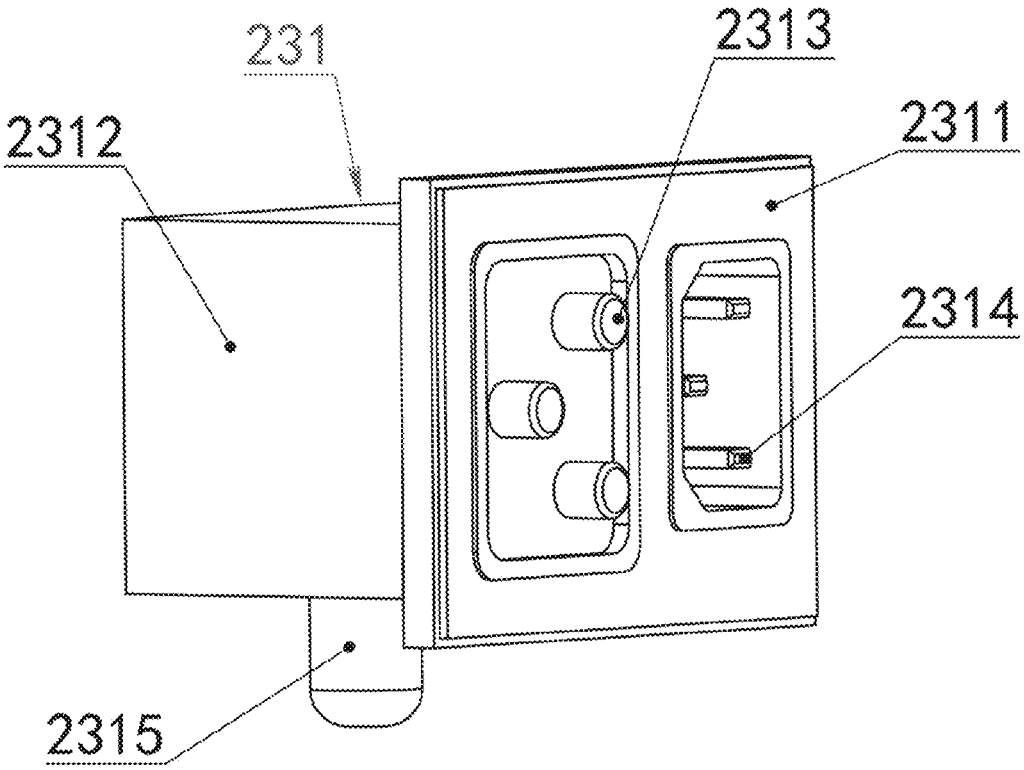
FIG. 3 is a schematic diagram of the structure of a quick-connection plug board according to the present invention.

After receiving the delivery order, the courier puts the refrigeration logistics box 2 containing the products in the rear box of the battery car. In order to guarantee the continuous refrigeration in the distribution process and during the storage period, elastic contact points 2313 and a storage battery standard plug 2314 are provided on the quick-connection plug board 231 of the side cover 23 of the refrigeration logistics box (referring to FIG. 3). During the delivery process, the refrigeration logistics box is powered by connecting the storage battery standard plug to the battery car, and the temperature selection switch 232 is turned on at the same time. According to the product requirements, two preservation modes of refrigeration and freezing can be selected to start the refrigeration device.

Figure 4:
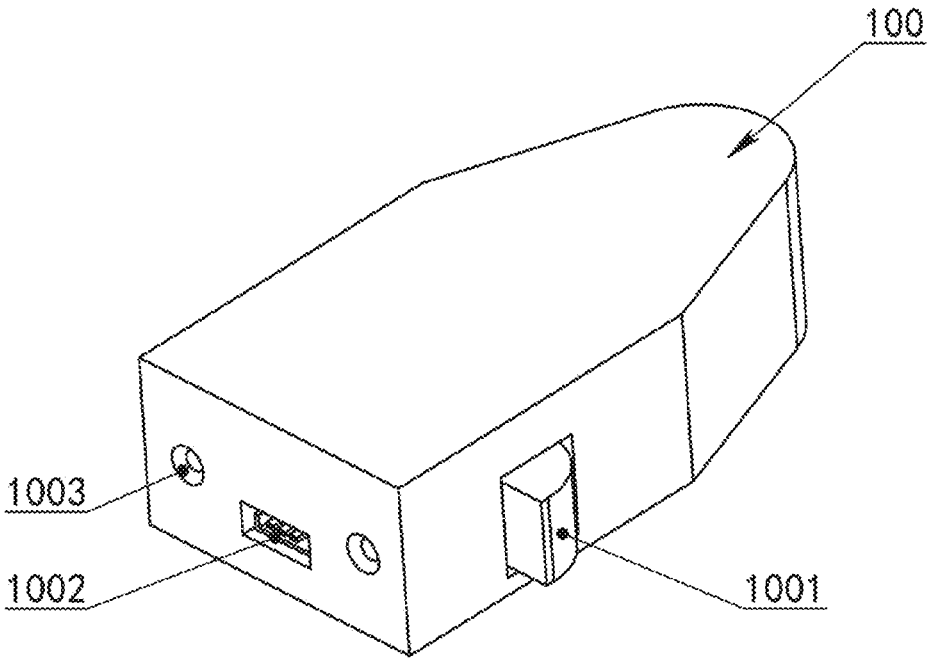
FIG. 4 is a schematic diagram of the structure of a limiting lock according to the present invention.
Figure 5:
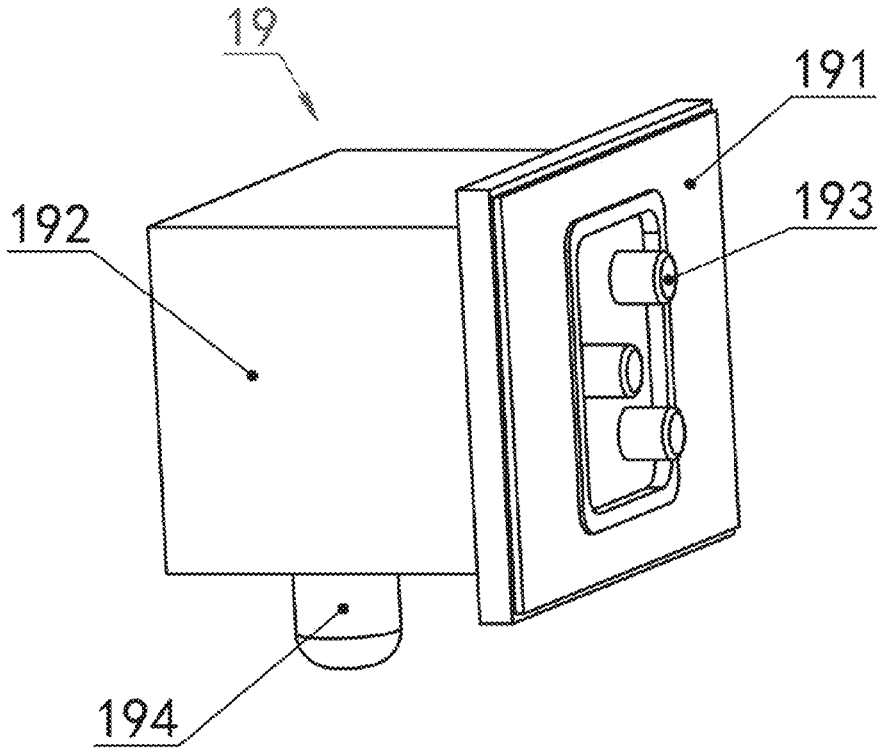
FIG. 5 is a schematic diagram of the structure of a contact power supply plug according to the present invention.

After arriving at the delivery address, the courier aligns the identification 25 of the logistics box with the scanner 17, and the electric door lock 151 and limiting lock 100 of the corresponding unit cell 110 open at the same time. The electronic lock tongue 1001 on the limiting lock is quickly locked into the positioning slot bayonet 213 to limit and fix the logistics box in place. At the same time, the elastic contact points 193 on the contact power supply plug 19 contact the elastic contact points 2313 on the quick-connection plug board 231 to maintain the power supply. Once the electric door lock is closed, the customer receives the pickup information (referring to FIGS. 4 and 5).

In order to avoid the overhigh temperature in the unit cell 110 caused by the heat dissipated from refrigeration, the self-service fresh product pickup cabinet 1 is provided with an air flow channel, and air guide grooves 211 are formed on the bottom of the logistics box 2. The air enters the unit cell 110 through the inlet holes 1021 of the inlet channel, the inlet channel 102, and the inlet holes 1022 of the unit cell 110 on the inner side of two columns of unit cells 110. The inlet fan 1023 of the inlet channel maintains a positive air pressure in the inlet channel. The air flows upward and downward through the guide grooves 211 to uniformly bring the heat to the exhaust holes 1011 of the unit cell 110 on the outer side of the two columns of unit cells 110, and then exits through the exhaust channel 101 and the exhaust holes 1012 of the exhaust channel.

The customer picks up the products with the pickup information, and the electric door lock 151 of the unit cell 110 and the limiting lock 100 open synchronously. The logistics box 2 can be put back by secondary code scanning after the product is taken out.

In addition, it should be noted that the scanner and the touch display screen mentioned in the embodiment are all existing structural parts, and will not be described again.

The self-service fresh product pickup cabinet of the present invention can also be used as a general self-service fresh product pickup cabinet.

The distribution method using the fresh product cold chain distribution device comprises:

toggling the temperature selection switch 232 of the refrigeration logistics box 2 to select a temperature suitable for preserving the distributed fresh products; during transportation from the logistics center to the centralized distribution point, the refrigeration logistics box with the products being placed on a shelf of a logistics transport vehicle, wherein the shelf is equipped with a contact plug, and power is supplied to the refrigeration device of the refrigeration logistics box through the quick-connection plug board 231 on the refrigeration logistics box and the contact power supply plug 19, keeping the refrigeration device 24 working and ensuring a constant temperature in the refrigeration logistics box throughout the whole process;

supplying power to the refrigeration logistics box by using the shelf equipped with the contact power supply plug 19 or by connecting the storage battery standard plug 2314 on the quick-connection plug board 231 of the refrigeration logistics box to a storage battery of a battery car when the refrigeration logistics box 2 is stored at the centralized distribution point or is distributed by the courier;

identifying the identification 25 of the refrigeration logistics box with the scanner 17 on the self-service fresh product pickup cabinet 1 to open the electric door lock 151 of the unit cell 110; when the courier puts the refrigeration logistics box 2 into the unit cell 110, the limiting lock 100 cooperating with the positioning slot 212 to guide and fix the refrigeration logistics box 2; after the control panel 103 detects the connection of the power supply contact points, the touch display screen 18 of the self-service fresh product pickup cabinet 1 prompting to close the door panel 15 of the unit cell 110 and sending a pickup verification code to the consumer; powering the refrigeration logistics box 2 through the contact power supply plug 19 inside the self-service pickup cabinet unit cell 110; the exhaust channel 101 and the inlet channel 102 constituting an air circulation system to discharge the heat released during refrigeration of the refrigeration logistics box 2;

after the consumer inputs the pickup verification code, the electric door lock 151 and the limiting lock 100 of the unit cell 110 being automatically unlocked; the consumer taking away the fresh products directly from the refrigeration logistics box 2 and returning back the refrigeration logistics box 2 to the unit cell 110 immediately; after the control system of the self-service fresh product pickup cabinet detects the connection of the power supply contact points in the unit cell 110, the touch display screen 18 of the self-service fresh product pickup cabinet 1 prompting to close the door panel 15 of the unit cell 110; the consumer closing the door panel of the unit cell 110 to complete the pickup; then the control system of the self-service fresh product pickup cabinet cutting off the power of the power supply system of the unit cell 110 to prevent energy consumption from the vacant refrigeration logistics box 2; or the consumer opting for a network credit guarantee and then taking away the refrigeration logistics box 2, and the self-service fresh product pickup cabinet 1 reserving the corresponding unit cell 110 after the consumer takes away the refrigeration logistics box 2; the consumer returning the refrigeration logistics box 2 back by scanning again the identification 25 of the refrigeration logistics box;

recycling and reusing the refrigeration logistics box 2; the courier putting in a new refrigeration logistics box 2 in the next delivery and retrieving the vacant refrigeration logistics box 2 for reuse.

What is claimed is:

1. A fresh product cold chain distribution device, comprising a self-service fresh product pickup cabinet and at least one refrigeration logistics box, wherein the self-service fresh product pickup cabinet comprises a cabinet body, a side panel, a back panel, a top panel, a door panel, an air channel cover panel, an exhaust channel, an inlet channel, a scanner, a touch display screen, and a control panel;

the cabinet body comprises a plurality of unit cells, wherein each unit cell is provided with a contact power supply plug, a limiting lock, and an electric door lock, and both sides of each unit cell are provided with exhaust holes and inlet holes;

the exhaust channel of the self-service fresh product pickup cabinet is arranged at an outer side of two columns of the plurality of unit cells, and the inlet channel is arranged between the two columns of the plurality of unit cells; the exhaust channel connects the exhaust holes and exhaust holes of the exhaust channel; the inlet channel connects inlet holes of the inlet channel and the inlet holes;

the exhaust holes are positioned adjacent to a top of a side panel of the unit cell and are communicated with the exhaust channel; the inlet holes are positioned adjacent to a bottom of a side panel of the unit cell and are communicated with the inlet channel;

the refrigeration logistics box comprises a box body, a box cover, a side cover, a refrigeration device, and an identification, and the refrigeration logistics box is allowed to be fixedly placed in the self-service fresh product pickup cabinet through the limiting lock, wherein the refrigeration device adopts electronic semiconductor refrigeration;

a bottom of the box body is provided with a positioning slot, and the positioning slot is provided with a positioning slot bayonet, the positioning slot bayonet is matched with the limiting lock in the unit cell;

air guide grooves are further formed on the bottom of the box body.

2. The fresh product cold chain distribution device according to claim 1, wherein the contact power supply plug in the unit cell comprises a plug panel, a plug box body, elastic contact points, and a power connection port.

3. The fresh product cold chain distribution device according to claim 1, wherein the limiting lock in the unit cell is matched with the positioning slot of the refrigeration logistics box for guiding and fixing the refrigeration logistics box; the limiting lock comprises an electronic lock tongue allowed to lock into the positioning slot bayonet, a control line connection port, and a mounting hole, and the limiting lock is synchronous with the electric door lock.

4. The fresh product cold chain distribution device according to claim 1, wherein the side cover of the refrigeration logistics box is provided with a quick-connection plug board, and the quick-connection plug board is provided with electrically conductive elastic contact points and a storage battery standard plug; the side cover of the refrigeration logistics box is further provided with a temperature selection switch, wherein two preservation temperature modes of refrigeration and freezing are set for the refrigeration device.

5. The fresh product cold chain distribution device according to claim 1, wherein the box body is made of hard insulating material, and a surface of the box body has a heat dissipation function.

6. The fresh product cold chain distribution device according to claim 1, wherein the refrigeration device for refrigerating is provided within the refrigeration logistics box.

7. The fresh product cold chain distribution device according to claim 1, wherein the identification of the refrigeration logistics box is a unique identification code of the refrigeration logistics box.

8. The fresh product cold chain distribution device according to claim 1, wherein the exhaust channel and the inlet channel are arranged on two sides of the plurality of unit cells of the self-service fresh product pickup cabinet.

9. A fresh product cold chain distribution method, wherein the fresh product cold chain distribution method uses the fresh product cold chain distribution device according to claim 1 and comprises:

toggling a temperature selection switch of the refrigeration logistics box to select a temperature suitable for preserving distributed fresh products; during transportation from a logistics center to a centralized distribution point, the refrigeration logistics box with the products being placed on a shelf of a logistics transport vehicle, wherein the shelf is equipped with a contact plug, and power is supplied to the refrigeration device of the refrigeration logistics box through a quick-connection plug board on the refrigeration logistics box and the contact power supply plug, keeping the refrigeration device working and ensuring a constant temperature in the refrigeration logistics box throughout the whole process;

supplying power to the refrigeration logistics box by using the shelf equipped with the contact power supply plug or by connecting a storage battery standard plug on the quick-connection plug board of the refrigeration logistics box to a storage battery of a battery car when the refrigeration logistics box is stored at the centralized distribution point or is distributed by a courier;

identifying the identification of the refrigeration logistics box with the scanner on the self-service fresh product pickup cabinet to open the electric door lock of the unit cell; when the courier puts the refrigeration logistics box into the unit cell, the limiting lock cooperating with the positioning slot to guide and fix the refrigeration logistics box; after the control panel detects a connection of power supply contact points, the touch display screen of the self-service fresh product pickup cabinet prompting to close the door panel of the unit cell and sending a pickup verification code to a consumer; powering the refrigeration logistics box through the contact power supply plug inside the unit cell; the exhaust channel and the inlet channel constituting an air circulation system to discharge heat released during refrigeration of the refrigeration logistics box;

after the consumer inputs the pickup verification code, the electric door lock and the limiting lock of the unit cell being automatically unlocked; the consumer taking away the fresh products directly from the refrigeration logistics box and returning back the refrigeration logistics box to the unit cell immediately; after a control system of the self-service fresh product pickup cabinet detects the connection of the power supply contact points in the unit cell, the touch display screen of the self-service fresh product pickup cabinet prompting to close the door panel of the unit cell, and the consumer closing the door panel of the unit cell to complete the pickup; then the control system of the self-service fresh product pickup cabinet cutting off the power of a power supply system of the unit cell to prevent energy consumption from the vacant refrigeration logistics box; or the consumer opting for a network credit guarantee and then taking away the refrigeration logistics box, and the self-service fresh product pickup cabinet reserving the corresponding unit cell after the consumer takes away the refrigeration logistics box; the consumer returning the refrigeration logistics box back by scanning again the identification of the refrigeration logistics box;

recycling and reusing the refrigeration logistics box; the courier putting in a new refrigeration logistics box in the next delivery and retrieving the vacant refrigeration logistics box for reuse.

10. The fresh product cold chain distribution method according to claim 9, wherein in the fresh product cold chain distribution device, the contact power supply plug in the unit cell comprises a plug panel, a plug box body, elastic contact points, and a power connection port.

11. The fresh product cold chain distribution method according to claim 9, wherein in the fresh product cold chain distribution device, the limiting lock in the unit cell is matched with the positioning slot of the refrigeration logistics box for guiding and fixing the refrigeration logistics box; the limiting lock comprises an electronic lock tongue allowed to lock into the positioning slot bayonet, a control line connection port, and a mounting hole, and the limiting lock is synchronous with the electric door lock.

12. The fresh product cold chain distribution method according to claim 9, wherein in the fresh product cold chain distribution device, the side cover of the refrigeration logistics box is provided with the quick-connection plug board, and the quick-connection plug board is provided with electrically conductive elastic contact points and the storage battery standard plug; the side cover of the refrigeration logistics box is further provided with the temperature selection switch, wherein two preservation temperature modes of refrigeration and freezing are set for the refrigeration device.

13. The fresh product cold chain distribution method according to claim 9, wherein in the fresh product cold chain distribution device, the box body is made of hard insulating material, and a surface of the box body has a heat dissipation function.

14. The fresh product cold chain distribution method according to claim 9, wherein in the fresh product cold chain distribution device, the refrigeration device for refrigerating is provided within the refrigeration logistics box.

15. The fresh product cold chain distribution method according to claim 9, wherein in the fresh product cold chain distribution device, the identification of the refrigeration logistics box is a unique identification code of the refrigeration logistics box.

16. The fresh product cold chain distribution method according to claim 9, wherein in the fresh product cold chain distribution device, the exhaust channel and the inlet channel are arranged on two sides of the plurality of unit cells of the self-service fresh product pickup cabinet.

* * * * *